US006626190B2

(12) United States Patent
Durth et al.

(10) Patent No.: US 6,626,190 B2
(45) Date of Patent: Sep. 30, 2003

(54) METHOD FOR AUTOMATICALLY CLEANING COOKING DEVICES

(75) Inventors: Wilfried Durth, Landsberg (DE); Peter Wiedemann, Klosterlechfeld (DE)

(73) Assignee: Rational Aktiengesellschaft, Landsberg/Lech (DE)

( * ) Notice: Subject to any disclaimer, the term of this patent is extended or adjusted under 35 U.S.C. 154(b) by 0 days.

(21) Appl. No.: 09/737,207

(22) Filed: Dec. 14, 2000

(65) Prior Publication Data

US 2001/0011549 A1 Aug. 9, 2001

(30) Foreign Application Priority Data

Dec. 21, 1999 (DE) ..... 199 61 835

(51) Int. Cl.[7] ..... B08B 9/093

(52) U.S. Cl. ..... 134/22.18; 134/2; 134/18; 134/22.11; 134/22.12; 134/24; 126/20; 126/273 R; 99/340

(58) Field of Search ..... 134/2, 18, 22.11, 134/22.12, 22.18, 24, 25.2, 34, 56 R, 57 D, 56 D, 104.1, 172, 173, 174, 198; 126/20, 273 R; 99/340

(56) References Cited

U.S. PATENT DOCUMENTS 1,755,918 A * 4/1930 Fagley ..... 99/340
3,329,529 A * 7/1967 Lamar ..... 126/273 R
3,373,754 A * 3/1968 Squire ..... 126/273 R
3,410,116 A * 11/1968 Levinson ..... 134/115 R
3,549,294 A * 12/1970 Kerr et al. ..... 134/115 R
3,986,891 A * 10/1976 Rumbaugh ..... 126/20
5,800,628 A * 9/1998 Erickson et al. ..... 134/18

FOREIGN PATENT DOCUMENTS

| | | |
|---|---|---|
| DE | 962 641 | 6/1967 |
| EP | 0 652 405 | 5/1995 |
| EP | 0 859 543 | 8/1998 |
| EP | 0 967 851 | 12/1999 |

* cited by examiner

*Primary Examiner*—Randy Gulakowski
*Assistant Examiner*—Gentle E. Winter
(74) *Attorney, Agent, or Firm*—Schiff Hardin & Waite

(57) ABSTRACT

In a method and an apparatus for automatically cleaning at least the cooking chamber of a cooking device upon use of a fluid, the fluid is selected from a first fluid comprising cleaning agent, rinse agent, decalcification agent, water and/or the like, and/or from a second fluid that is acquired from the third fluid discharging from the cooking chamber during cleaning on the basis of at least partial cleaning thereof. At least one spray head is provided to which the first fluid from at least a first reservoir and/or the second fluid can be supplied via a line system from a processing unit connected to the discharge conduit of the cooking chamber. The processing unit has at least a second reservoir, a cleaning unit, and a pump unit.

6 Claims, 1 Drawing Sheet

METHOD FOR AUTOMATICALLY CLEANING COOKING DEVICES

BACKGROUND OF THE INVENTION

The present invention is directed to a method as well as to an apparatus for automatically cleaning at least one cooking chamber of a cooking device upon utilization of a fluid.

For example, DE 198 38 864, corresponding to U.S. patent application Ser. No. 09/763,505 incorporated herein by reference, discloses a method for cleaning a cooking chamber as well as an apparatus employed for this purpose, whereby at least one spray nozzle can be arranged in the cooking chamber, and in addition to a rotational movement with up to three degrees of rotational freedom, can also be moved around a pivot point, so that an optimum spraying of the complete cooking chamber as well as rails or the like potentially arranged therein can occur. The spray nozzle is to be connected to a traditional water main such as a household water supply system upon interposition of a back-absorption prevention unit. In addition, connections between the spray nozzle and one or more containers for a cleaning agent, a rinse agent and/or a decalcification agent can be provided upon interposition of a respective valve. This leads to a high use of water, cleaning agent, decalcification agent and/or rinsing agent, which is disadvantageous due to limited resources worldwide.

On the other hand, it is known from the field of automatic dishwashing devices to recirculate rinse water, i.e. to at least partially re-employ it.

Controlling cooking processes upon utilization of specific sensor mechanisms has established itself in the meantime. Even intelligent cooking process sensors have already been developed, see DE 199 45 021, corresponding to U.S. patent application Ser. No. 09/664,465 incorporated herein by reference.

SUMMARY OF THE INVENTION

An object of the invention is to develop a method or apparatus such that the disadvantages of the prior art are overcome, particularly in that the consumption of water, cleaning agent, decalcification unit, rinse agent and/or the like is reduced.

According to a method of the invention the fluid is selected from a first fluid comprising cleaning agent, rinse agent, decalcification agent, water and/or the like, and/or is composed of a second fluid that is acquired from the third fluid running out from the cooking chamber during cleaning on the basis of at least partial cleaning thereof.

It is thereby preferably provided that the fluid is selected dependent on acquired cooking chamber properties such as how dirty the cooking chamber is, material of the cooking chamber, temperature in the cooking chamber, degree of movement of the atmosphere in the cooking chamber and/or the like, dependent on cooking device operating conditions such as operating mode, operating time, type of material to be cooked, weight of material to be cooked, the frequency with which the cooking chamber door is opened and/or the like, and/or dependent on characteristics of the first, second and/or third fluids such as degree of contamination, hardness and/or the like.

The object directed to the apparatus is achieved according to the invention by at least one spray head to which a first fluid such as cleaning agent, rinse agent, decalcification agent, water and/or the like can be supplied via a line system from at least one first reservoir and/or to which a second fluid can be supplied from a processing unit connected to a discharge conduit of the cooking chamber and comprising at least one second reservoir, a cleaning unit as well as a pump unit.

It can thereby be provided that the cleaning unit for acquiring the second fluid from the third fluid emerging from the cooking chamber during cleaning via the discharge conduit comprises a separating unit in the form of a filter system or the like.

It is also provided according to the invention that the second fluid can be intermediately stored in the second reservoir, and that the processing unit comprises a discharge to a third reservoir or the like for a fourth fluid, whereby the fourth fluid together with the second fluid represents the third fluid, and the fourth fluid comprises a greater degree of contamination compared to the second fluid.

It can also be provided according to the invention that the first and/or second fluid can be supplied in controllable or regulatable fashion via the pump unit, preferably via a respectively controllable or regulatable valve.

Embodiments are preferred according to the invention that are characterized in that the processing unit has a sensor unit, and the sensor unit outputs data for controlling or regulating, in particular, the pump unit, the valve or the valves, a blower, a heating unit and/or a display.

It can thereby be provided that the sensor unit acquires cooking chamber properties such as how dirty the cooking chamber is, material of the cooking chamber, temperature in the cooking chamber, degree of motion of the atmosphere in the cooking chamber and/or the like, acquires cooking device operating conditions such as operating mode, operating time, type of material to be cooked, weight of material to be cooked, frequency with which the cooking chamber door is opened and/or the like, and/or acquires characteristics of the first, second, third and/or fourth fluid such as degree of contamination, hardness and/or the like.

It is also provided according to the invention that the sensor unit acquires the degree of contamination via optical characteristics, conductances, smells and/or pH values.

The invention also provides that the sensor unit acquires the filling level of the first, second and/or third reservoir.

In a development of the invention the spray head is movable and the movement of the spray head can be acquired, controlled and/or regulated via the sensor unit.

Finally, it is provided also with the invention that the sensor unit is integrated in a cooking process sensor or is connectible thereto.

The invention is thus based on the surprising perception that considerable resources can be saved when, instead of the previous direct connections to water mains as well as storage containers for cleaning agent, rinse agent, decalcification agent and/or the like, and cleaning water that flows off, is at least partially re-employed. It is thereby particularly preferred when highly contaminated dirty water is directly discharged, whereas less highly contaminated dirty water is resupplied to the cleaning circulation. The control of the cleaning circulation should thereby preferably automatically occur with the invention via a specific sensor mechanism.

The term "fluid" also covers particles entrained by a fluid medium, and crumbs or the like that, in particular contribute to the contamination of the fluid.

Further features and advantages of the invention derive from the following description wherein an exemplary embodiment of the invention is explained in detail on the basis of schematic drawings.

DESCRIPTION OF THE PREFERRED EMBODIMENTS

Figure 1:
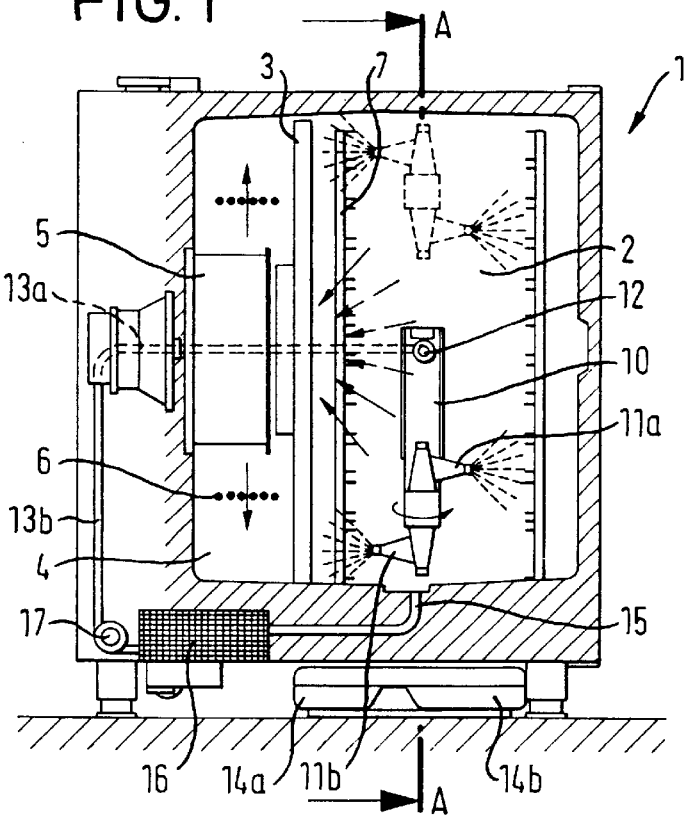
FIG. 1 is a sectional view through a cooking chamber having an apparatus of the invention.
Figure 2:
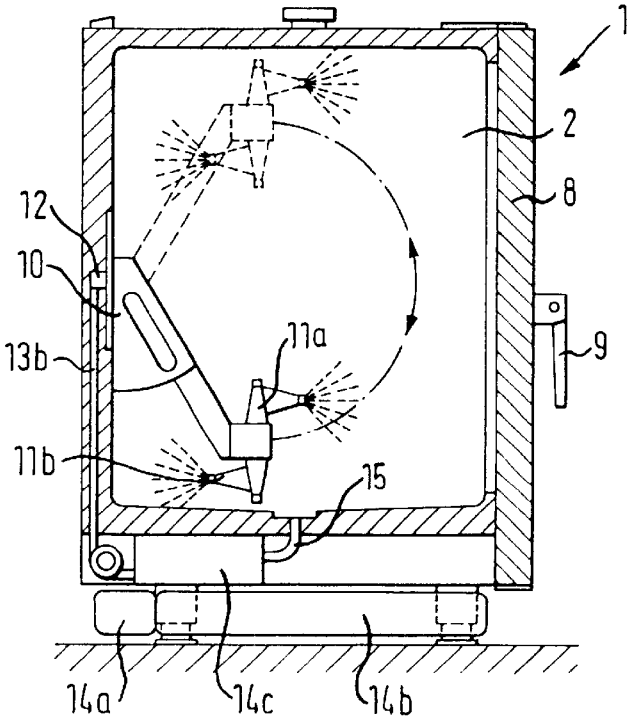
FIG. 2 is a sectional view along the line A—A of FIG. 1.

A traditional cooking device 1 comprises a cooking chamber 2 that is separated from a blower chamber 4 via an air baffle plate 3, as shown in FIGS. 1 and 2. A blower as well as the heating unit 6 are arranged in the blower chamber 4. A suspension rack 7 for inserts or the like is arranged in the cooking chamber 2. The cooking chamber 2 can be closed with a door handle 9 via a cooking chamber door 8.

As a component part of the inventive apparatus of the invention for automatically cleaning at least the cooking chamber, a rotationally movable spray arm 10 is located in the cooking chamber 2, this having one end secured to a wall of the cooking chamber and comprising two oppositely residing spray heads 11, 11*b* at its free end that are rotatable around a shared pivot point. Such a system with spray arm 10 and spray heads 11*a*, 11*b* is disclosed in DE 198 38 864 corresponding to U.S. patent application Ser. No. 09/764,505 so that the disclosure therein is referenced in view of further details. The spray heads 11*a*, 11*b* are supplied with a fluid via a conduit system upon interposition of a fluid coupling 12, whereby the conduit system comprises a conduit 13*a* for fresh water from a water supply network 18 (FIG. 2) as well as a conduit 13*b* for a further fluid from at least one of the three reservoirs 14*a*, 14*b* and 14*c*. The rinse agent and the decalcification agent are thereby contained in the reservoir 14*a*, cleaning agent is contained in the reservoir 14*b*, and the waste water from the cooking chamber 2 is contained in the reservoir 14*c*, this proceeding into the reservoir 14*c* via discharge conduit 15 from the cooking chamber 2. The waste water from the reservoir 14*c*, however, can be supplied to the spray heads 11*a*, 11*b* via the conduit 13*b* exclusively after passing a separator unit 16 for removing dirt particles above a certain size and upon utilization of a circulating pump 17 (FIGS. 1, 2, 3).

Recourse is therefore not to be had exclusively to the fresh water, cleaning agent, rinse agent and/or decalcification agent in every cleaning process; rather, the waste water already employed for cleaning can be reprocessed and re-employed, i.e. recycled, at least partially.

For this purpose, as shown in FIG. 3, the separator unit 16 can represent a filter system 19 and controllable valves 20, 21, 22 and 23 can be arranged in the connection from the reservoirs 14*a*, 14*b*, 14*c* via the conduit 13*b* to the spray heads 11*a*, 11*b*. These valves, just like the circulating pump 17, are preferably connected according to the invention (via lines 32, 33, 34 and 35) to a sensor unit 24 that, for example, acquires the degree of contamination of the waste water in the reservoir 14*c* (signal line 25) as well as the filling level of the reservoirs 14*a*, 14*b* and 14*c* (signal lines 26, 27, and 28 respectively) and outputs corresponding data for the control of the cleaning process. For processing the acquired data, the sensor unit can be equipped with or connected to a microprocessor 30. The sensor unit can also be in an interactive connection with a display (not shown) for displaying acquired data. Further, the sensor unit can be integrated in a cooking process sensor 31 or can be connected thereto (line 29), as disclosed, for example, in DE 199 45 021, corresponding to U.S. patent application Ser. No. 09/664,465 incorporated herein by reference.

Due to the use of the sensor unit 24, it can also be advantageously assured that a desired cleaning of the cooking chamber occurs in the following cooking process despite the recycling of the waste water of a first cleaning process. The cleaning with fluid, of course, can also be promoted by controlling the temperature of the heating unit 6 as well as the rotational speed of the blower 5, preferably via the sensor unit, as disclosed in DE 198 38 864 corresponding to U.S. patent application Ser. No. 763,505, incorporated herein by reference.

Although various minor modifications might be suggested by those skilled in the art, it should be understood that our wish to embody within the scope of the patent warranted hereon all such modifications as reasonably and properly come with the scope of our contribution to the art.

We claim as our invention:

1. A method for automatically cleaning a cooking chamber of a cooking device, comprising the steps of:

cleaning the cooking chamber by use of a fluid introduced into the cooking chamber;

deriving said fluid by a controllable mixing of a first fluid with a second fluid;

providing the first fluid as at least one of a cleaning agent, a rinse agent, a decalcification agent, and water;

providing the second fluid from a separating unit which receives a third fluid which comprises waste water being discharged from the cooking chamber during cleaning; and the controllable mixing being based on data from a sensor unit.

2. The method according to claim 1 wherein the controllable mixing is controlled by a microprocessor receiving said data from the sensor unit.

3. The method according to claim 1 wherein the separating unit removes dirt particles above a certain size from the third fluid to produce the second fluid.

4. The method according to claim 1 wherein the separating unit is in the form of a filter system.

5. The method according to claim 1 wherein the spray head is movable, and the movement of the spray head is at least one of acquired, controlled, and regulated via data acquired by the sensor unit.

6. The method according to claim 1 wherein the sensor unit is at least one of integrated and connectible to a cooking process sensor.

* * * * *